US005666696A

United States Patent [19]

Costard

[11] Patent Number: 5,666,696

[45] Date of Patent: Sep. 16, 1997

[54] PROCESS FOR TREATING SCLERENCHYMA FIBERS, IN PARTICULAR FLAX

[75] Inventor: Herbert Costard, Neu Wulmsdorf, Germany

[73] Assignee: Windi Winderlich GmbH, Hamburg, Germany

[21] Appl. No.: 564,300

[22] PCT Filed: Jun. 21, 1994

[86] PCT No.: PCT/EP94/02022

§ 371 Date: Dec. 20, 1995

§ 102(e) Date: Dec. 20, 1995

[87] PCT Pub. No.: WO95/01468

PCT Pub. Date: Jan. 12, 1995

[30] Foreign Application Priority Data

Jun. 3, 1993 [DE] Germany ..... 43 22 399.0

[51] Int. Cl.[6] ..... D01B 1/42; D01G 21/00; D01G 13/00

[52] U.S. Cl. ..... 19/7

[58] Field of Search ..... 19/7; 435/297

[56] References Cited

U.S. PATENT DOCUMENTS

| | | | |
|---|---|---|---|
| 1,959,400 | 5/1934 | Withey | 435/279 X |
| 2,871,163 | 1/1959 | Turnbull | 435/279 |
| 4,568,739 | 2/1986 | Jaskowski | 435/279 X |
| 4,617,383 | 10/1986 | Jaskowski | 435/279 X |

FOREIGN PATENT DOCUMENTS

| | | | |
|---|---|---|---|
| 0129724A3 | 1/1985 | European Pat. Off. . | |
| 0527666A1 | 2/1993 | European Pat. Off. . | |
| 3923498 A1 | 1/1991 | Germany . | |
| 61-160407 | 7/1986 | Japan . | |
| 1208101 | 1/1986 | U.S.S.R. | 435/279 |
| 1650804 | 5/1991 | U.S.S.R. | 435/279 |
| 2162554 | 2/1986 | United Kingdom . | |

OTHER PUBLICATIONS

Application Possibilities of Steam Pretreated Flax Fibers in the Spinning Mill, Schenek et al., Melliano Textilberichte, Jun. 1993, E197–E200.

*Primary Examiner*—John J. Calvert
*Attorney, Agent, or Firm*—Foley & Lardner

[57] ABSTRACT

A process for sclerenchyma fibers, in particular flax, includes mechanical treatment accompanied by formation of a fiber strip and alignment of the fibers essentially parallel to one another. The fibers of the fiber strip are freed of wood constituents, greases, pectins and other impurities by a chemical and/or cooking treatment of the fiber strip. The treated fiber strip is dried and then divided into shorter sections. These sections are at least partly pulled apart or opened to form fiber bundles. The fiber bundles are carded at a set moisture content of at least 10%-wt. and combined to give a fine fiber strip.

18 Claims, 2 Drawing Sheets

PROCESS FOR TREATING SCLERENCHYMA FIBERS, IN PARTICULAR FLAX

TECHNICAL FIELD

The invention generally relates to a process for the treatment of sclerenchyma fibers, in particular flax. More particularly, this invention relates to mechanical treatment of sclerenchyma fibers accompanied by formation of a fiber strip and alignment of the fibers essentially parallel to one another.

BACKGROUND OF THE INVENTION

In known processes of this type (DE-B-3 414 437) the treatment takes place through mechanical scutching and hackling, i.e. beating and combing of the fibers. More specifically, the flax fibers are clamped and then treated by means of hackling combs with the result that wood constituents and the like are removed while the fibers are aligned parallel to one another. The bast is then divided into long fibers, which are kept clamped and aligned in parallel, and into so-called tow. The tow consists of very short fibers which are combed out of the clamped long fibers and removed.

From the combined long fibers, a yarn is usually produced in subsequent treatment steps. The yarn is then processed, for example, to form textile materials. The long fibers continue to contain wood constituents and other impurities to a certain extent, in particular being unbleached.

The long fibers produced by hackling cannot be mixed with short fibers of other materials, say cotton, to form mixed yarns. This is because the machines used for wet spinning of long fibers cannot process such a fiber mixture, in addition to these machines working very slowly. The long fibers are therefore processed without the addition of other fibers to form a roving or finished yarn. The roving, which has acquired a certain strength and fiber adhesion through a first spinning step, is usually cleaned and bleached. In comparison, a cleaning of the finished yarn is more difficult because the cleaning liquor penetrates the finished yarn much more poorly than the roving.

The tow produced during the treatment by hackling is either directly processed to form relatively coarse yarns or carded in such a way that short fibers form (so-called cottonizing). The short fibers are used unbleached for the manufacture of yarns or fleeces. If the tow is subjected to a washing and bleaching process, such as flock or batch cooking, a mass of cleaned and bleached short fibers forms. This mass, however, is very matted, and in some cases the fibers are twisted or entwined with one another. It is therefore not possible to directly produce from this mass a fiber structure that can be processed further to make filaments, other than through strong mechanical tearing. However, such tearing leads to substantial waste and to fiber shortening.

It is also already known (DE-A-3 923 498) to delignify and prepare flax by passing it through mechanical treatment stations in several steps. The flax fibers, which have already been mechanically pre-treated, are brought into a degree of parallel alignment with the help of needle-bearing conveyor belts. The treated and aligned fibers are then stacked via other conveyor belts to give a fiber hank.

The fiber hank obtained in this way contains a mixture of long fibers and short fibers, in addition to still containing wood constituents and other impurities. The fibers, aligned in longitudinal direction and parallel to one another, initially have practically no bond whatsoever with one another. This is because the needles of the conveyor belts all circulate in the same direction and at essentially the same rate of feed, thus merely aligning the neighboring flax fibers in the direction of feed without forming a bond between neighboring fibers. This bond is achieved only by following conveyor belts which, in addition to their feed motion, also create a degree of cross movement of the flax fibers, thereby intending to form fiber bundles. However, this does not result in a noteworthy bonding of neighboring fibers.

It is also known (DE-A-1 927 043) to collect wool to form a fiber strip which is then subjected to a steam treatment to remove grease that is present. This steaming can take place during various stages of the treatment of the fiber strip. This treatment process usually includes stretching operations, but can also include brushing and combing, to obtain a fiber strip which can be processed to give a wool yarn. However, such a process is not suitable for the preparation of sclerenchyma fibers, in particular flax, because the sclerenchyma fibers present in the fiber strips produced by customary treatment processes are too stiff and not fine enough.

SUMMARY OF THE INVENTION

The object of the invention is to provide a process in which sclerenchyma fibers, in particular flax fibers, are treated so that final fibers are obtained which are comparable to cotton fibers in terms of their structure and their properties. Such comparable fibers can then be correspondingly processed.

A process in accordance with the present invention is developed in such a way that the fibers of the fiber strip are freed of wood constituents, greases, pectins and other impurities by a chemical and/or cooking treatment of the fiber strip. The treated fiber strip is dried, and the fiber strip is then divided into shorter sections. The sections are at least partly pulled apart to form fiber bundles, and the fiber bundles are then carded at a set moisture content of at least 10%-wt. and combined to give a fine fiber strip.

BRIEF DESCRIPTION OF THE DRAWINGS

A preferred embodiment of the present invention will hereinafter be described in conjunction with the drawings, wherein.

DETAILED DESCRIPTION OF THE PREFERRED EMBODIMENT

Figure 1:
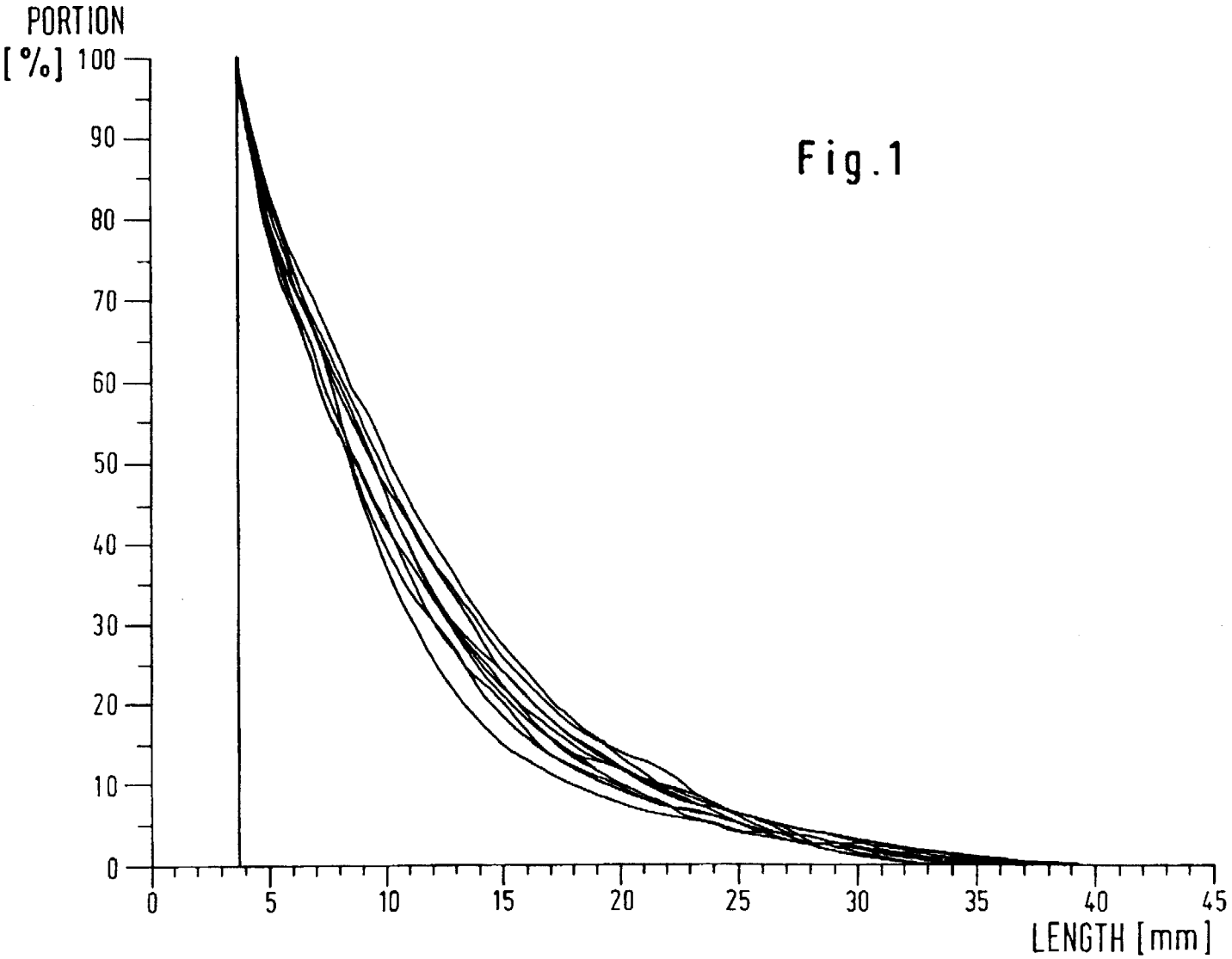
FIG. 1 is a diagram showing the fiber length distribution for fibers produced in the Example.

The practice when processing sclerenchyma fibers, in particular flax fibers, has for decades, if not centuries, been to subject the finished yarn or at least the roving to the cleaning step. Surprisingly, it has been shown the fiber strip can be subjected to a conventional cleaning operation without dissolution of the fiber bond. Moreover, the fibers hold together even when the fiber strip is wet and retain their aligned position.

When applying such a process step to a fiber strip made from wool or the like, there is a further treatment of the fiber strip for processing to give a yarn, i.e. stretching operations and smoothings usually take place. With the process according to the invention the treated fiber strip is divided into smaller sections, such a division being practically possible only if the fiber strip was dried beforehand.

The division into shorter sections can take place through cutting or through tearing of the fiber strip. Cutting has the advantage that it is more easily carried out and produces precisely defined section lengths. However, cutting results in a relatively large portion of very short fiber pieces which are not suitable for further processing. On the other hand, tearing the fiber strip into shorter sections is somewhat more expensive and leads to section lengths which are not precisely defined. However, tearing does have the advantage of reducing the portion of fiber pieces that are destroyed, i.e., those fibers no longer capable of being further processed because of their small length.

The fibers inside the produced sections are in an essentially parallel alignment, and the fiber bundles forming the sections are at least partly pulled apart. That is, they are subjected to an operation which is called "opening" in cotton processing. In cotton processing, this "opening" or "pulling apart" takes place inside a layer of cotton which was previously peeled off from a cotton bale.

If the fiber bundles are in a standard climate, a moisture content of 9%-wt. results (the term "%-wt." refers to the weight of water relative to the total weight of the fiber material, which is water plus solids). To separate the fibers essentially into elementary fibers during the subsequent carding, a somewhat higher moisture content must be established. In particular, a moisture content between 10%-wt. and 30%-wt. is established, upwardly limited by the processability on the card. Preferably, the moisture content is between 11%-wt. and 17%-wt., even more preferably between 12%-wt. and 14%-wt., and in a particularly preferred embodiment 13%-wt. As a result of the increased moisture content, the hydrogen bridges keeping the fibers together dissolve without the fibers sticking in the card. The fibers produced in this way, when combined to give a fine fiber strip, have a structure surprisingly similar to cotton if they are flax fibers. The fine fiber strip can then be further processed in the same way as cotton fibers, say by spinning to obtain a yarn.

The length of the sections to be manufactured from the fiber strip is essentially determined by the ability of the card used to process long fibers. The longer the sections chosen, the lower the fiber losses. The length preferably lies between 50 mm and 250 mm, and in particular between 65 mm and 120 mm. The setting of the moisture content of the fiber bundles for the carding can take place in a particularly advantageous way by setting the moisture content of the fiber strip appropriately prior to the division into smaller sections.

It is also possible to color the fiber strip after the cleaning by a chemical and/or cooking treatment. Therefore, it becomes possible to mix fiber bundles of sclerenchyma fibers, in particular flax fibers, of different colors with one another to obtain a fine fiber strip which is mottled by the differently colored fibers.

More importantly, the process makes it possible to mix sclerenchyma fibers, in particular flax fibers, with other types of fiber, e.g., wool or cotton. This was not previously possible if it was desired to obtain a cleaned yarn from such a mixing operation and further processing. For example, sclerenchyma fibers (in particular flax fibers) can be cleaned only by a very different cleaning process than wool, and the chemicals of the cleaning processes have a harmful effect on the other type of fiber. Previously, however, flax fibers could be cleaned only very inadequately when in a state broken down into short fibers. As mentioned above, the tow consisting of short fibers is transformed by a washing and bleaching operation into a mass of fibers which are very matted and, in some cases, twisted and entwined with one another. Because of this matting and twisting, the mass can be further processed only very poorly. Therefore, the cleaning of the flax fibers has previously been carried out only when these were present in the form of a half-yarn or yarn.

The fiber bundles produced according to the present invention consist of cleaned sclerenchyma fibers, in particular flax fibers. These cleaned and spinnable fibers can be mixed with similarly cleaned wool or cotton fibers, then combined by carding to give a fine fiber strip, and finally processed to give a mixed yarn. The wool or cotton fibers are usually added while dry because the problem of the dissolution of hydrogen bonds during the carding does not exist with them.

The flax fibers produced according to the invention have roughly the same abrasion properties as synthetic fibers currently used for the manufacture of mixed yarns comprising synthetic fibers and wool or cotton. The flax fibers produced according to the invention can therefore form a replacement for the synthetic fibers used at present.

EXAMPLE

Flax tow (bast fiber bundle) customary in the trade was parallelized on a Mackie carding machine and freed of all but 5% of the wood constituents present in the flax tow. The continuous fiber strip obtained was laid out in a width of ca. 3 cm.

The fiber strip obtained was conducted in two passes at a speed of 5 m/min through a continuously operating unit from Construzione Machine Tessile, Schio, Italy. The unit has a card sliver transfer station with 16 card slivers, an assembly comprising Foulard (chemicals impregnation apparatus) and intermediate steamer, a depositing steamer, 4 screening drum machines (Lisseuse washes), a screening drum drier and a card can coiler.

In the first pass, an impregnation took place in the assembly comprising Foulard and intermediate steamer at 60° C. and a pressure of 2 psi above atmospheric (=13.7895 kPa) with a wash solution consisting of:

35 ml/l NaOH 50 °Bé

6 g/l Cottoclarin OJ (wetting agent surfactant)

3 g/l Securon 540 (complexing agent)

2 g/l Defindol EN (deaerator)

[the agents used are products of Henkel KGaA, D üsseldorf].

The pass took place at speed setting PIV, position "C 2", and the liquor absorption was 72%. The treated fiber strip was then treated in the depositing steamer for 30 minutes with saturated steam of 102° C. Drying took place at 140° C. to 150° C.

The thus-treated fiber strip was conducted through the same unit for bleaching. The bleaching took place in the assembly comprising Foulard and intermediate steamer at 20° C. and at a pressure of 2 psi above atmospheric (=13.7895 kPa) with an impregnating agent consisting of:

0.15 g/l magnesium sulphate 8 ml/l water glass 38 °Bé

5 ml/l sodium hydroxide solution 50 °Bé

6 g/l Cottoclarin OK 2 g/l Securon 540

2 g/l Belsoft 200 (plasticizer)

60 ml/l hydrogen peroxide 35%

The speed setting was the same as in the previous washing operation, and the liquor absorption was 71%. The treatment in the depositing steamer took place under the same conditions as during the washing process. The fiber strip was then dried at 140° C. to 150° C. and at a rate of 5 m/min to a residual moisture of ca. 10%. The thus-obtained fiber strip(s) were cut on a staple fiber cutting machine type NMC 290 from Neumag Neumünstersche Maschinenund Anlagenbau GmbH, Neumünster, to form sections 77 mm long.

The 77 mm-long sections were passed through a card, displaying semi-flexible packing, from Trützschler GmbH & Co. KG, Mönchengladbach, for further processing. Prior to the carding operation, in order to improve the fiber-to-fiber adhesion in the spraying process, a finish with 1% melt KB 109/2 and 1% adhesion promoter Silkol HV 86 from Henkel KGaA, Düsseldorf, was applied. A residual moisture of between 10% and 13% was maintained during the carding operation.

Figure 2:
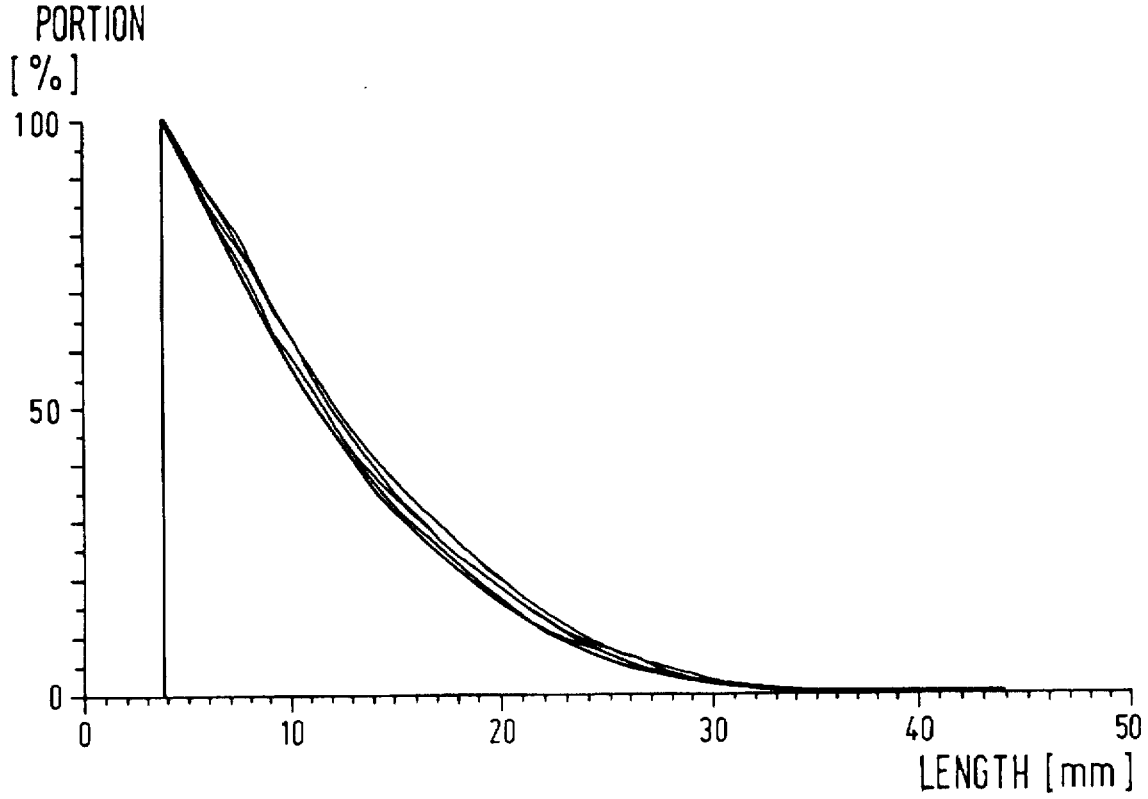
FIG. 2 is a diagram showing the fiber length distribution for cotton fibers.

Referring now to FIG. 1, the dimensions of the thus-obtained fibers agreed largely with the dimensions of cotton fibers. In particular, the obtained portions of fiber lengths for 10 drawn samples are shown in the fiber diagram. The portion of fibers having at least the length given on the abscissa, i.e., equal to the given length or longer, is plotted on the ordinate. As is immediately seen, this fiber length distribution is essentially the same as a fiber length distribution of cotton, as is represented in the fiber diagram of FIG. 2. Moreover, the fiber thickness of the obtained flax fibers was, as an examination under the microscope shows, of the same order as the fiber thickness of the cotton fibers.

It will be understood that the above description is of preferred exemplary embodiments of the invention, and that the invention is not limited to the specific embodiments shown. Modifications may be made in the embodiments described herein without departing from the scope of the present invention as expressed in the appended claims.

I claim:

1. A process for treating sclerenchyma fibers by mechanical treatment accompanied by formation of a fiber strip and alignment of the fibers essentially parallel to one another, comprising:

treating the fiber strip by a chemical or cooking treatment to free the fibers of wood constituents, greases, pectins and other impurities;

drying the treated fiber strip;

dividing the fiber strip into shorter sections;

pulling the sections at least partly apart to form fiber bundles; and carding the fiber bundles, the fiber bundles having a set moisture content of at least 10%-wt., and combining the fiber bundles to form a fine fiber strip.

2. The process of claim 1, wherein the sclerenchyma fibers comprise flax.

3. The process of claim 1 wherein the dividing step comprises cutting the fiber strip into shorter sections.

4. The process of claim 1, wherein the dividing step comprises tearing the fiber strip into shorter sections.

5. The process of claims 1, wherein the dividing step comprises manufacturing sections of a length between 50 mm and 250 mm.

6. The process of claim 5, wherein the dividing step comprises manufacturing sections of a length between 65 mm and 120 mm.

7. The process of claim 1 further comprising treating the fiber strip to set the moisture content prior to the division step.

8. The process of claim 1, wherein the maximum moisture content is 30%-wt.

9. The process of claim 1, wherein the moisture content is between 11%-wt. and 17%-wt.

10. The process of claim 9, wherein the moisture content is between 12%-wt. and 14%-wt.

11. The process of claim 1, further comprising dying the treated fiber strip.

12. The process of claim 11, further comprising, prior to the carding step, mixing the fiber bundles with fiber bundles made from the same material but having a different color.

13. The process of claim 1, further comprising, prior to the carding step, mixing the fiber bundles with fibers of another material.

14. The process of claim 13, further comprising using wool or cotton fibers as the fibers of another material.

15. The process of claim 14, further comprising using the wool or cotton fibers while dry.

16. The process of claim 1, further comprising spinning the fine fiber strip to obtain a yarn.

17. The process of claim 1, wherein the drying step further comprises drying the treated fiber strip to a moisture content in the range of 10 to 30%-wt.

18. A yarn containing sclerenchyma fibers, the yarn made by the process of claim 1.

* * * * *

UNITED STATES PATENT AND TRADEMARK OFFICE

CERTIFICATE OF CORRECTION

PATENT NO. : 5,666,696

DATED : September 16, 1997

INVENTOR(S) : Costard, Herbert

It is certified that error appears in the above-indentified patent and that said Letters Patent is hereby corrected as shown below:

On the cover page, in the section entitled "[30] Foreign Application Priority Data", change the priority date from "Jun. 3, 1993" to --Jun. 30, 1993--

Signed and Sealed this

Twenty-fifth Day of May, 1999

*Attest:*

Q. TODD DICKINSON

*Attesting Officer*

*Acting Commissioner of Patents and Trademarks*